United States Patent [19]

Hodkin et al.

[11] Patent Number: 4,681,988

[45] Date of Patent: Jul. 21, 1987

[54] SWITCH SELECTOR MECHANISM

[75] Inventors: George A. Hodkin, Loughborough, England; Roger H. Blane, Krugersdorp, South Africa

[73] Assignee: Associated Electrical Industries Limited, England

[21] Appl. No.: 819,873

[22] Filed: Jan. 16, 1986

[30] Foreign Application Priority Data

Jan. 16, 1985 [GB] United Kingdom ..... 8501070

[51] Int. Cl.[4] ..... H01H 3/00

[52] U.S. Cl. ..... 200/17 R

[58] Field of Search ..... 200/153 SC, 17 R

[56] References Cited

U.S. PATENT DOCUMENTS 4,163,133 7/1979 Bould ..... 200/153 SC

*Primary Examiner*—J. R. Scott

*Attorney, Agent, or Firm*—Kirschstein, Kirschstein, Ottinger & Israel

[57] ABSTRACT

A selector mechanism, especially for actuating a switch and capable of selectively operating in two different modes utilizing the same operation of a common actuator, comprises a pair of links each connected at one end to an actuating member and carrying at the other end a projection engaging in a respective slot in an operating member, each of which slots has a recess into which the respective projection rests in a neutral position of the operating member, and a selector device operable to cause a surface thereof to engage one or other of the projections and retain it within the respective recess, so as to cause movement of the respective link to be transmitted to the operating member and move it in a direction determined by the link, while leaving the projection associated with the other link free to move along its respective slot.

6 Claims, 2 Drawing Figures

SWITCH SELECTOR MECHANISM

BACKGROUND OF THE INVENTION

This invention relates to selector mechanisms operable to enable a movable member to be moved in one or other direction from a neutral position, and relates especially, though not exclusively, to such a mechanism for use in actuating an electric switch device of the kind incorporating a series isolator, such a switch device comprising a movable switch member carrying contacts and arranged to be moved in one or other direction, from a central position, so as to engage either an isolator or an earth contact.

SUMMARY OF THE INVENTION

An object of the invention is to provide a simple form of selector mechanism capable of selectively operating in two different modes, utilizing the same operation of a common actuator.

According to the invention such a selector mechanism comprises an actuating member movable under the control of the actuator, a pair of links pivotally connected at one end to the actuating member, and each carrying at a position spaced from said end a projection engaging in a respective slot in an operating member, and a selector device operable to restrain one or other of the projections from moving along its respective slot, such that, on movement of the actuator, the operating member is caused to move in one or other direction, depending upon which of the projections is restrained from movement relative to the member, the other projection being free to slide along its respective slot.

The operating member may itself comprise a device required to be actuated under the control of the selector mechanism, or it may be coupled to such a device, possibly through one or more further links.

Thus, movement of the operating member may be employed to actuate, either directly or through an intermediate link, a movable conducting member of an interrupter/isolator assembly to cause it to engage either an isolator contact or an earth contact, the interrupter-/isolator assembly being, for example, as described in United Kingdom Published Patent Application No. 2143090A.

The actuating member and the operating member are preferably both pivotable about respective axes. The selector device is preferably also pivotable, and has a surface capable of engaging the projections in different angular positions of the device so as to restrain one or other of the projections in dependence upon the position of the device. The slots preferably terminate in transverse recesses in which the projections, conveniently in the form of rollers, are alternatively retainable by the surface, being thereby prevented from movement along the respective slot.

The actuator may be manually operable, and may, for example, comprise a handle connected or connectable to a rotatable shaft, carrying a lever coupled by means of a connecting link to the actuating member, although the means for moving the actuating member can alternatively take any other suitable form.

BRIEF DESCRIPTION OF THE DRAWINGS

The invention will be further explained by describing, by way of example, with reference to FIGS. 1 and 2 of the accompanying schematic drawings, one selector mechanism in accordance with the invention for operating a switch device of the kind having an isolator position.

In the drawings

DETAILED DESCRIPTION OF THE PREFERRED EMBODIMENT

Figure 1:
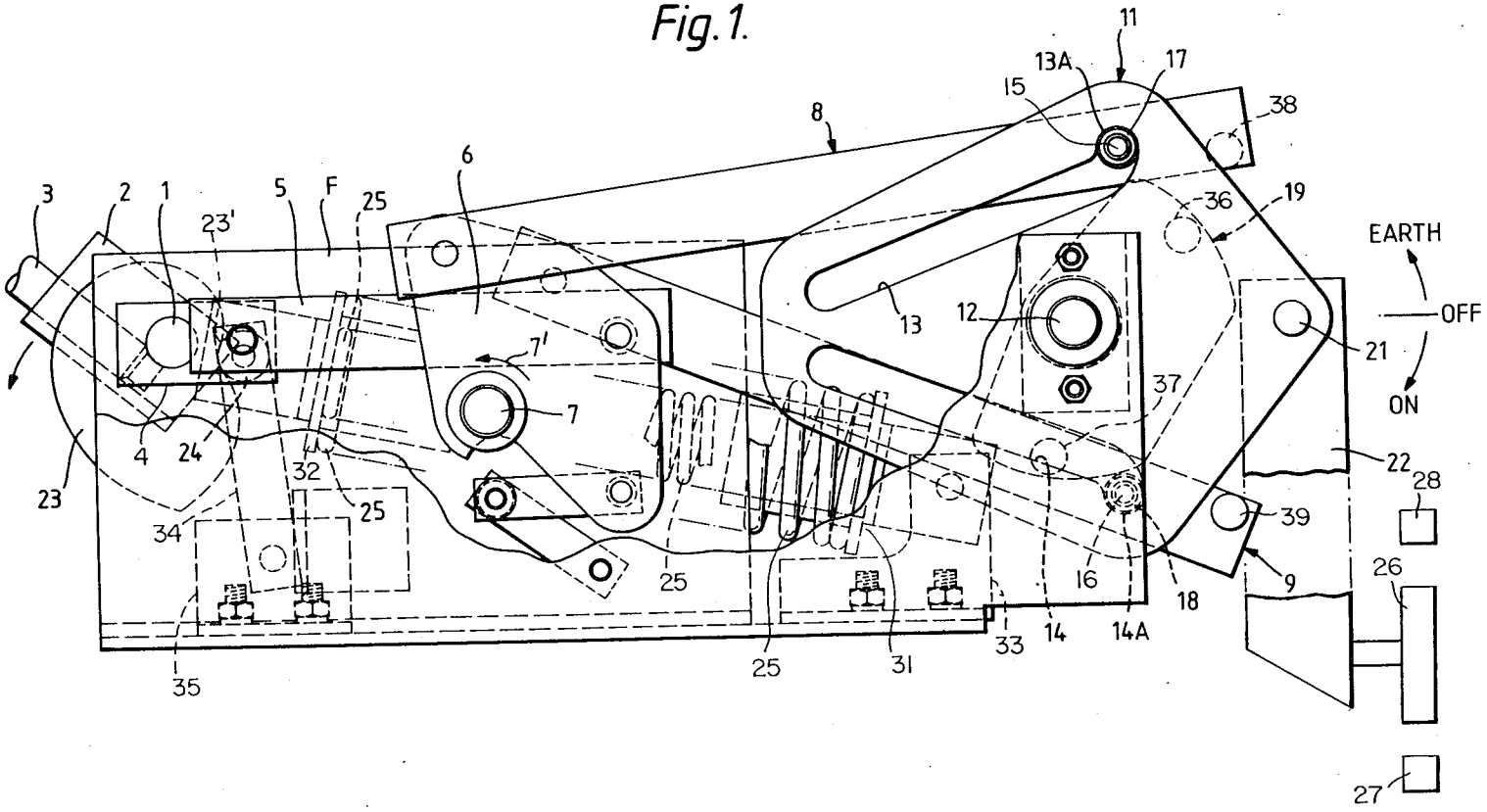
FIG. 1 represents a side view of the mechanism in diagrammatic form to illustrate its manner of operation.
Figure 2:
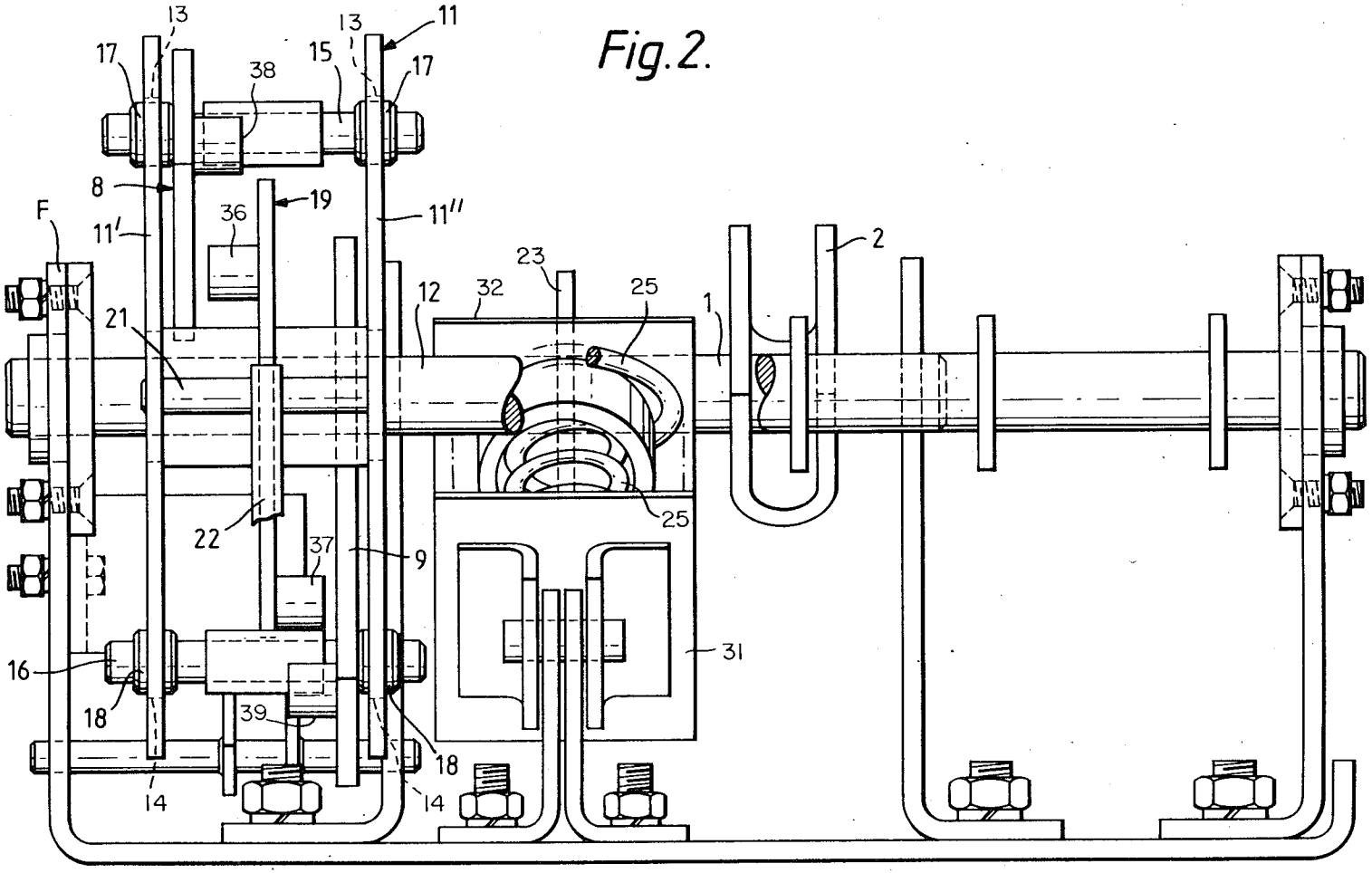
FIG. 2 represents an end view of the mechanism.

Thus referring to the drawings, a shaft 1, pivotably supported in a framework F, carries a U-shaped bracket 2 into which can be fitted an operating handle shown in part at 3 in FIG. 1. A lever 4, fixed to the shaft 1, is pivotably coupled to a link 5, which is, in turn, pivotably coupled to a further lever 6 mounted for rotation on a shaft 7 as indicated by the arrow 7'. Downward movement of the handle 3 through approximately 90° causes the link 5 to move to the left in the view shown in FIG. 1, this causing the lever 6 to rotate in the anti-clockwise direction. A pair of links 8, 9 are pivotably attached to the lever 6 and therefore also move to the left as the lever rotates. An output lever 11, is mounted on a shaft 12, and comprises two parallel plates 11', 11'' as shown in FIG. 2 each of which has a pair of generally straight slots 13, 14, terminating at the ends furthest from the lever 6 with transverse recesses 13A, 14A. The ends of the links 8, 9 remote from the lever 6 are fixed to shafts 15, 16 respectively, each carrying at their ends rollers 17, 18 which engage within corresponding ones of the slots 13, 14.

A selector 19 rotatably supported on the shaft 12 between the output lever plates 11' and 11'' and can be rotated relative to the shaft in an anticlockwise direction through about 70° from the position shown in FIG. 1, by means of a suitable control device such as a bowden-type cable or other mechanical linkage (not shown).

In the neutral or "OFF" position of the output lever, as shown in FIG. 1, the rollers 17, 18 are located at the recessed ends of the slots 13, 14. Now, with the selector 19 in the position shown, if the handle 3 is moved downwards the links 8, 9 will also move to the left as previously explained. The rollers 18 on the link 9 are held within the respective recesses 14A by the operative surface of the selector 19 and, as a result, the output lever 11 will rotate in the clockwise direction and, as the selector 19 is not interfering with the rollers 17 on the link 8, these will just idle along the respective slots 13.

The plates 11' and 11'' of the output lever 11 carry between them a spindle 21 which passes through a drive link 22, so that as the output lever rotates the drive link moves downwards. This link can be arranged to operate a switch mechanism as described in the aforesaid United Kingdom Published Patent Application No. 2143090A, to cause a movable conducting bar 26 of the switch to move into an "ON" position so as to engage an isolator contact as at 27, for example.

However if, with the output lever in the "OFF" position, the selector 19 is rotated through approximately 70° in the anticlockwise direction by rotation of the shaft 12 as previously explained, the rollers 17 of the link 8 will be restrained by the operative surface of the selector, and the rollers 18 of the link 9 will be free to move along the respective slots 14. Consequently when the links 8, 9 are moved to the left on downward movement of the handle 3, the output lever 11 will rotate in the anticlockwise direction and move the drive link 22 upwards, so causing the conducting bar 26 of the switch mechanism to move to the "EARTH" position so as to engage an earth contact 28.

The shaft 1 to which the handle 3 can be connected conveniently carries a cam 23 having a depression 23' into which a spring loaded roller 24 is urged by means of a pair of coaxial compression/springs 25 when the handle is in the raised "OFF" position.

The roller 24 is carried by one of a pair of end caps 31, 32, between which the springs 25 act, the first end cap 31 being pivotally coupled to a bracket 33 bolted to the framework F, and the second end cap 32, which carries the roller 24, being pivotally coupled to one end of a link 34, the other end of which is pivotally coupled to a further bracket 35. The engagement of the spring loaded roller 24 in the depression 23' of the cam 23 ensures that the remainder of the mechanism, including the drive link 22, is held securely in the "OFF" position until the lever 4 is positively actuated by depression of the handle 3, this resulting in the rotation of the cam 23 causing it to bear against the roller 24, and thereby compressing the springs 25. At the same time, the rotation of the lever 4 is transmitted to the lever 6 through the link 5.

Although the lever 6 has been shown as being operated by a handle and link mechanism it will be appreciated that other methods of achieving the required rotation of the lever can alternatively be employed.

The mechanism conveniently includes safety means for preventing the selector 19 from being rotated when the output lever 11 and hence the drive link 22 are in positions corresponding to the "ON" or "EARTH" positions of the switch. This comprises a pair of stubs 36 and 37 carried by the selector 19 and cooperating stubs 38, 39 carried by the links 8 and 9, respectively. Thus, if the mechanism is as shown in FIG. 1 with the selector 19 set to lock the roller 18 in its slot 14, anticlockwise movement of the lever 6, produced by downward movement of the handle 3, will cause clockwise movement of the output lever, and move the drive link 22 to the "ON" position. The stub 39 on the link 9 will then have moved in close proximity with the adjacent stub 37 on the selector 19, thus preventing rotation of the latter while the link 22 and the switch conducting bar 26 remain in the "ON" position.

Similarly, the stub 38 on the link 8 cooperates with the other stub 36 on the selector 19 to prevent operation of the latter while the link 22 and the switch conducting bar 26 are in the "EARTH" position.

Moreover although the selector mechanism, as above described, is concerned with the operation of a switch mechanism it could also be used to advantage for other purposes where the same movement of an actuating member is required to produce two different modes of operation.

We claim:

1. A selector mechanism, comprising:

(a) an actuator;

(b) an actuating member movable under the control of the actuator;

(c) an operating member having a pair of elongated slots each having a recess adjacent one end, said operating member being pivotally movable in one or other direction from a neutral position;

(d) a pair of elongated links pivotally connected at one end to the actuating member and each link carrying, at a position spaced from said connected end, a projection engaging in a respective one of the slots in the operating member, each projection being located within a respective recess when the operating member is in said neutral position; and (e) a selector device movable to cause a surface thereof to engage one or other of the projections so as to retain the respective projection within its respective recess, to cause movement of the actuating member to be transmitted to the operating member, so as to pivot the operating member in the direction determined by movement of the respective link, while leaving the projection carried by the other link free to leave its respective recess and move along its slot.

2. The selector mechanism according to claim 1, wherein each projection comprises a shaft and an associated roller carried by the shaft, the roller engaging the respective slot, and the selector device being movable to engage the shaft.

3. The selector mechanism according to claim 1; and further comprising link means connected between the operating member and a movable conducting member of an interrupter/isolator assembly, for transmitting movement of the operating member to the conducting member so as to cause the latter to engage either an isolator or an earth contact in dependence upon the direction of movement of the operating member.

4. The selector mechanism according to claim 1, wherein the actuating member and the operating member are supported by shafts disposed parallel to each other but spaced apart and are each pivotable about the axis along which the respective shaft extends.

5. The selector mechanism according to claim 4, wherein the selector device is pivotable about the shaft of the operating member and has a peripheral surface engageable with one or other of the projections in dependence upon the angular position of the device.

6. The selector mechanism according to claim 1, wherein the actuator incorporates a manually operable handle, a shaft to which the handle is connected, a lever carried by the shaft, and means linking the lever with the actuating member to enable the latter to be moved and thereby move the operating member in said one or other direction, as determined by the setting of the selector device, by manual operation of the handle.

* * * * *